US008053998B2

(12) United States Patent
Lin

(10) Patent No.: US 8,053,998 B2
(45) Date of Patent: Nov. 8, 2011

(54) INVERTER AND DRIVING DEVICE OF BACKLIGHT MODULE

(75) Inventor: Feng-Li Lin, Taishan Township, Taipei County (TW)

(73) Assignee: Gigno Technology Co., Ltd., Taipei (TW)

( * ) Notice: Subject to any disclaimer, the term of this patent is extended or adjusted under 35 U.S.C. 154(b) by 0 days.

(21) Appl. No.: 11/976,558

(22) Filed: Oct. 25, 2007

(65) Prior Publication Data

US 2008/0100230 A1 May 1, 2008

(30) Foreign Application Priority Data

Oct. 25, 2006 (TW) ..... 95139407 A
Oct. 19, 2007 (TW) ..... 96139224 A

(51) Int. Cl.
*H05B 41/36* (2006.01)

(52) U.S. Cl. ..... 315/219; 315/177; 315/209 R

(58) Field of Classification Search ..... 315/177, 315/184, 185, 186, 191, 192, 193, 209 R, 315/210, 219, 220, 246, 250, 254, 255, 256, 315/257, 276, 277, 278, 279, 282, 312, 313, 315/323

See application file for complete search history.

(56) References Cited

U.S. PATENT DOCUMENTS

| | | | | |
|---|---|---|---|---|
| 4,424,468 | A * | 1/1984 | Zelina et al. | 315/222 |
| 5,621,281 | A * | 4/1997 | Kawabata et al. | 315/311 |
| 7,196,483 | B2 * | 3/2007 | Wey et al. | 315/312 |
| 2005/0093472 | A1 * | 5/2005 | Jin | 315/177 |
| 2005/0105305 | A1 * | 5/2005 | Sawada et al. | 363/34 |
| 2008/0061708 | A1 * | 3/2008 | Wi et al. | 315/277 |

* cited by examiner

*Primary Examiner* — Douglas W Owens
*Assistant Examiner* — Jianzi Chen
(74) *Attorney, Agent, or Firm* — Birch, Stewart, Kolasch & Brich, LLP

(57) ABSTRACT

An inverter for driving at least one light-emitting unit includes a switching circuit, an electric-isolated circuit and a transforming circuit. The switching circuit generates at least one switching signal according to a DC signal and at least one switching control signal. The electric-isolated circuit has an electric-isolated side and a non-electric-isolated side, which is electrically connected to the switching circuit electrically and generates a first power signal according to the switching signal. The transforming circuit is electrically connected to the electric-isolated side of the electric-isolated circuit, and generates a second power signal to drive the light-emitting unit according to the first power signal.

16 Claims, 24 Drawing Sheets

INVERTER AND DRIVING DEVICE OF BACKLIGHT MODULE

CROSS REFERENCE TO RELATED APPLICATIONS

This Non-provisional application claims priority under 35 U.S.C. §119(a) on Patent Application Nos. 095139407 filed in Taiwan, Republic of China on Oct. 25, 2006, and 096139224 filed in Taiwan, Republic of China on Oct. 19, 2007, the entire contents of which are hereby incorporated by reference.

BACKGROUND OF THE INVENTION

1. Field of Invention

The invention relates to an inverter and a driving device of a backlight module. More particularly, the invention relates to an inverter having an electric-isolating function, and a driving device of a backlight module.

2. Related Art

In general, a liquid crystal display (LCD) device includes a backlight module and a LCD panel. The backlight module mainly drives a light-emitting unit by a driving device, and thus provides a backlight source for the LCD device.

Referring to FIG. 1, a typical driving device 1 of a backlight module includes a power factor correcting circuit 11, a DC-to-DC power transforming circuit 12 and a DC-to-AC power transforming circuit 13 which is the so-called inverter. This architecture is usually referred to as the three-stage architecture.

The power factor correcting circuit 11 transforms a mains power (AC power) into a DC power with 400 volts. The power factor correcting circuit 11 mainly functions to make the voltage and the current in the circuit have the same phase such that the load approximates a resistive load and a better use efficiency can be obtained.

The DC-to-DC power transforming circuit 12 is electrically connected to the power factor correcting circuit 11 for dropping down the voltage of the DC power with 400V and thus outputting a DC power having a voltage lower than 400V. In addition, the reference voltage terminal of the rectified mains power is isolated from the ground of the load (light-emitting unit) in the DC-to-DC power transforming circuit 12 to prevent a user from being dangerously shocked due to the circuit formed by the user and the mains power when the user touches the ground of the load.

The DC-to-AC power transforming circuit 13 is electrically connected to the DC-to-DC power transforming circuit 12, and again transforms the DC power outputted from the DC-to-DC power transforming circuit 12 into an AC power for driving and thus lighting the light-emitting unit.

Recently, a driving device with the two-stage architecture has been disclosed, in which a DC-to-DC transforming circuit is omitted, and the DC power outputted from the power factor correcting circuit is directly transmitted to the inverter. Consequently, the cost of the DC-to-DC transforming circuit can be saved. However, the isolating function provided by the DC-to-DC transforming circuit has to be transferred to the inverter. The typical manufacturer uses an isolated transformer as a boost transformer in the inverter, so the size of the inverter is enlarged. In addition, the number of light-emitting units used in the backlight module is increased as the size of the LCD device is increased. Therefore, many sets of inverters are inevitably needed to drive the light-emitting units. Of course, the size and the manufacturing cost of the inverter are greatly increased therewith.

Therefore, it is an important subject of the invention to provide an inverter, which has a small size, an effectively decreased cost and an electric-isolating function, and a driving device of a backlight module.

SUMMARY OF THE INVENTION

In view of the foregoing, the invention is to provide an inverter, which has a small size, an effectively decreased cost and an electric-isolating function, and a driving device of a backlight module.

To achieve the above, the invention discloses an inverter for driving at least one load. The inverter includes a switching circuit, an electric-isolated circuit and a transforming circuit. The switching circuit generates at least one switching signal according to a DC signal and at least one switching control signal. The electric-isolated circuit has an electric-isolated side and a non-electric-isolated side. The non-electric-isolated side is electrically connected to the switching circuit and generates a first power signal according to the switching signal. The transforming circuit is electrically connected to the electric-isolated side of the electric-isolated circuit, and generates a second power signal to drive the load according to the first power signal.

To achieve the above, the invention also discloses a driving device of a backlight module for driving at least one load. The driving device includes a power switching control circuit and an inverter electrically connected to the power switching control circuit. The power switching control circuit generates at least one switching control signal. The inverter includes a switching circuit, an electric-isolated circuit and a transforming circuit. The switching circuit outputs at least one switching signal according to a DC signal and the switching control signal. The electric-isolated circuit has an electric-isolated side and a non-electric-isolated side. The non-electric-isolated side is electrically connected to the switching circuit and generates a first power signal according to the switching signal. The transforming circuit is electrically connected to the electric-isolated side of the electric-isolated circuit and generates a second power signal to drive the light-emitting unit according to the first power signal.

As mentioned above, an electric-isolated circuit is utilized to achieve the electric-isolating effect without modifying the design of the transforming circuit in the inverter and the driving device of the backlight module according to the invention. In addition, the drawback of the related art that the transforming circuits added with the increase of the number of the light-emitting units makes the size of the driving device be too large and increases the manufacturing cost due to the need of the isolating boost circuit can be improved.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
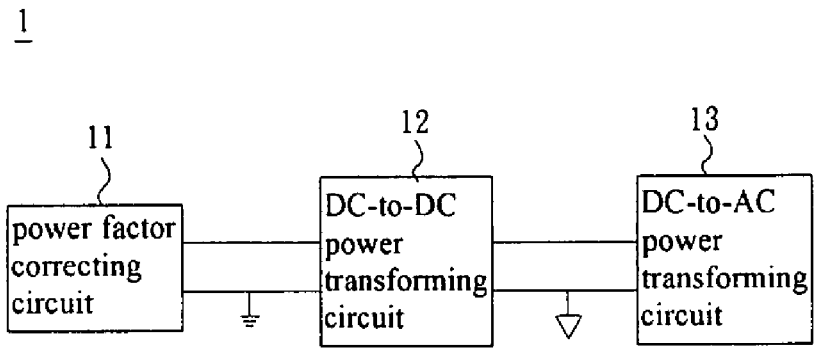
FIG. 1(PRIOR ART)
FIG. 1 is a schematic architecture illustration showing a conventional driving device of a backlight module.
Figure 2:
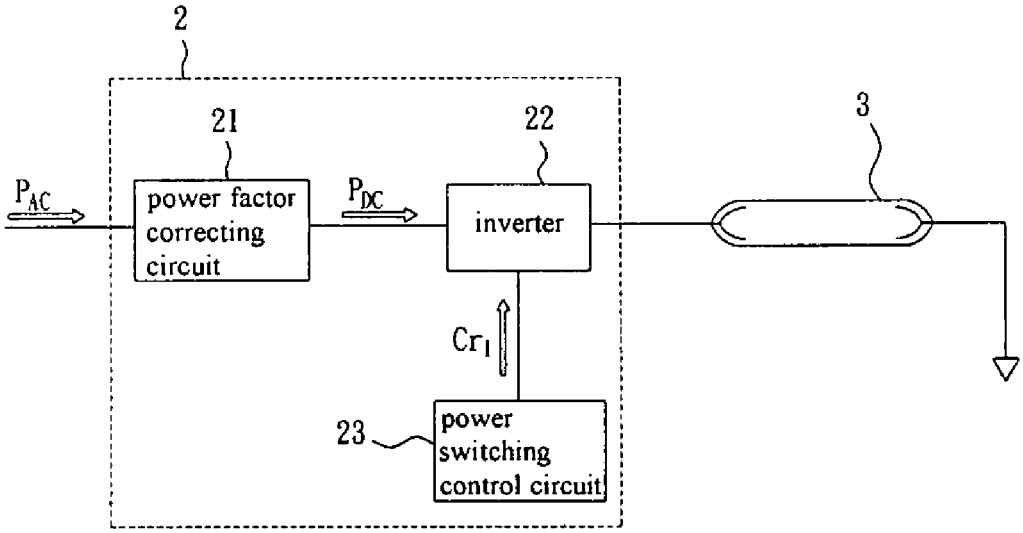
FIG. 2 is a schematic architecture illustration showing a driving device of a backlight module according to a preferred embodiment of the invention.

As shown in FIG. 2, a driving device 2 of a backlight module according to a preferred embodiment of the invention drives at least one load such as a light-emitting unit 3. In the embodiment, the light-emitting unit 3 is, for example but not limited to, a cold cathode fluorescent lamp (CCFL) or a light-emitting diode (LED). Hereinafter, the light-emitting unit 3 is a CCFL. The driving device 2 includes a power factor correcting circuit 21, an inverter 22 and a power switching control circuit 23. The inverter 22 is electrically connected to the power factor correcting circuit 21, the power switching control circuit 23 and the light-emitting unit 3. Herein, the term of electrically connecting can be directly electrically connecting or indirectly electrically connecting. The indirectly electrically connecting means two components are connected through an electrical conductive element.

The power factor correcting circuit 21 generates a DC signal $P_{DC}$ according to an AC power $P_{AC}$. The power switching control circuit 23 generates a switching control signal $C_{r1}$. The DC signal $P_{DC}$ and the switching control signal $C_{r1}$ are transmitted to the inverter 22 so that the inverter 22 can operate accordingly. In this embodiment, the power factor correcting circuit 21 functions to make the voltage and the current of the driving device 2 of the backlight module have the same phase, and to make its load approximate a resistive load (i.e., to make the power factor approach 1) so that the power quality and the use efficiency are enhanced.

Figure 3A:
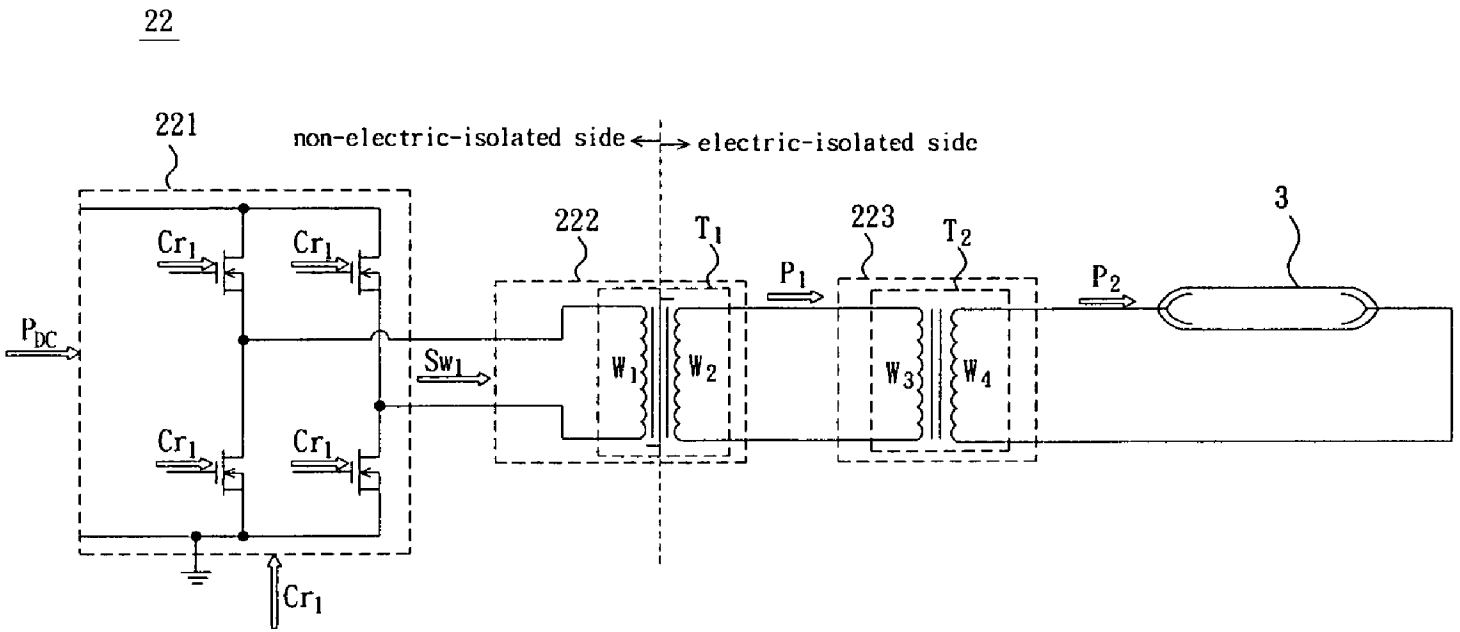
FIGS. 3A and 3B are schematic architecture illustrations each showing an inverter of the driving device of the backlight module according to the preferred embodiment of the invention.

Referring to FIG. 3A, the inverter 22 includes a switching circuit 221, an electric-isolated circuit 222 and a transforming circuit 223.

The switching circuit 221 is electrically connected to the power factor correcting circuit 21 and generates a switching signal $S_{w1}$ according to the DC signal $P_{DC}$ and the switching control signal $C_{r1}$. The switching circuit 221 is, for example but not limited to, a half-bridge switching circuit, a full-bridge switching circuit or a push-pull switching circuit. The switching circuit 221 includes at least one bipolar transistor (BJT), at least one field effect transistor (FET) or at least one diode. The switching circuit 221 can turn on or turn off according to the switching control signal $C_{r1}$ to transform the DC signal $P_{DC}$ into the switching signal $S_{w1}$. In this embodiment, the switching circuit 221 is the full-bridge switching circuit.

The electric-isolated circuit 222 has an electric-isolated side and a non-electric-isolated side electrically connected to the switching circuit 221. The electric-isolated circuit 222 generates a first power signal $P_1$ according to the switching signal $S_{w1}$. In this embodiment, the electric-isolated circuit 222 includes an isolated transformer $T_1$, which has a first winding $W_1$ located at the non-electric-isolated side and at least one second winding $W_2$ located at the electric-isolated side. The first winding $W_1$ is coupled to the second winding $W_2$.

Figure 3B:
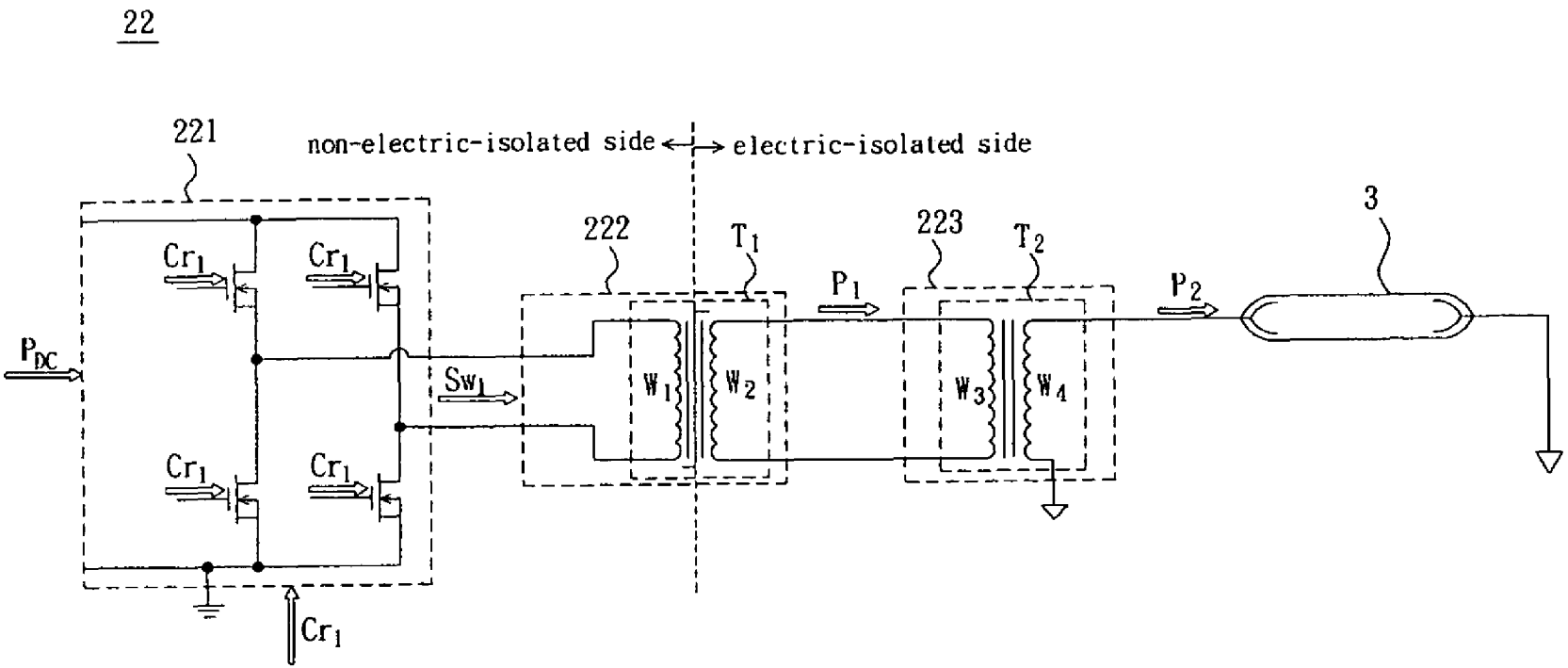

The transforming circuit 223 is electrically connected to the electric-isolated side of the electric-isolated circuit 222, and generates a second power signal $P_2$ to drive the light-emitting unit 3 according to the first power signal $P_1$. The transforming circuit 223 can be a boost circuit or a buck circuit. In this embodiment, since the light-emitting unit 3 is a CCFL, which needs larger driving voltage, the transforming circuit 223 is preferably a boost circuit. Moreover, the transforming circuit 223 may include at least one transformer such as a boost transformer or a buck transformer. Herein, the transforming circuit 223 is a boost transformer $T_2$, which has a primary winding $W_3$ and a secondary winding $W_4$ coupled to the primary winding $W_3$. The secondary winding $W_4$ is electrically connected to the light-emitting unit 3 and outputs the second power signal $P_2$ to drive the light-emitting unit 3. One end of the light-emitting unit 3 is electrically connected to a high-voltage end of the secondary winding $W_4$, and the other end of the light-emitting unit 3 is electrically connected to a low-voltage end of the secondary winding $W_4$. Of course, as shown in FIG. 3B, the other end of the light-emitting unit 3 and the low-voltage end of the secondary winding W4 are both grounded.

In this embodiment, each of the DC signal $P_{DC}$, the first power signal $P_1$ and the second power signal $P_2$ is a voltage signal. In addition, each of the first power signal $P_1$ and the second power signal $P_2$ can be an AC signal.

In addition, the driving device 2 may further include a resonant circuit (not shown) electrically connected between the electric-isolated circuit 222 and the transforming circuit 223. In the embodiment, the resonant circuit is an LC resonant tank, which can be a discrete component, the parasitic inductance or capacitance of the isolated transformer $T_1$, or the parasitic inductance or capacitance of the transforming circuit 223.

Figure 4A:
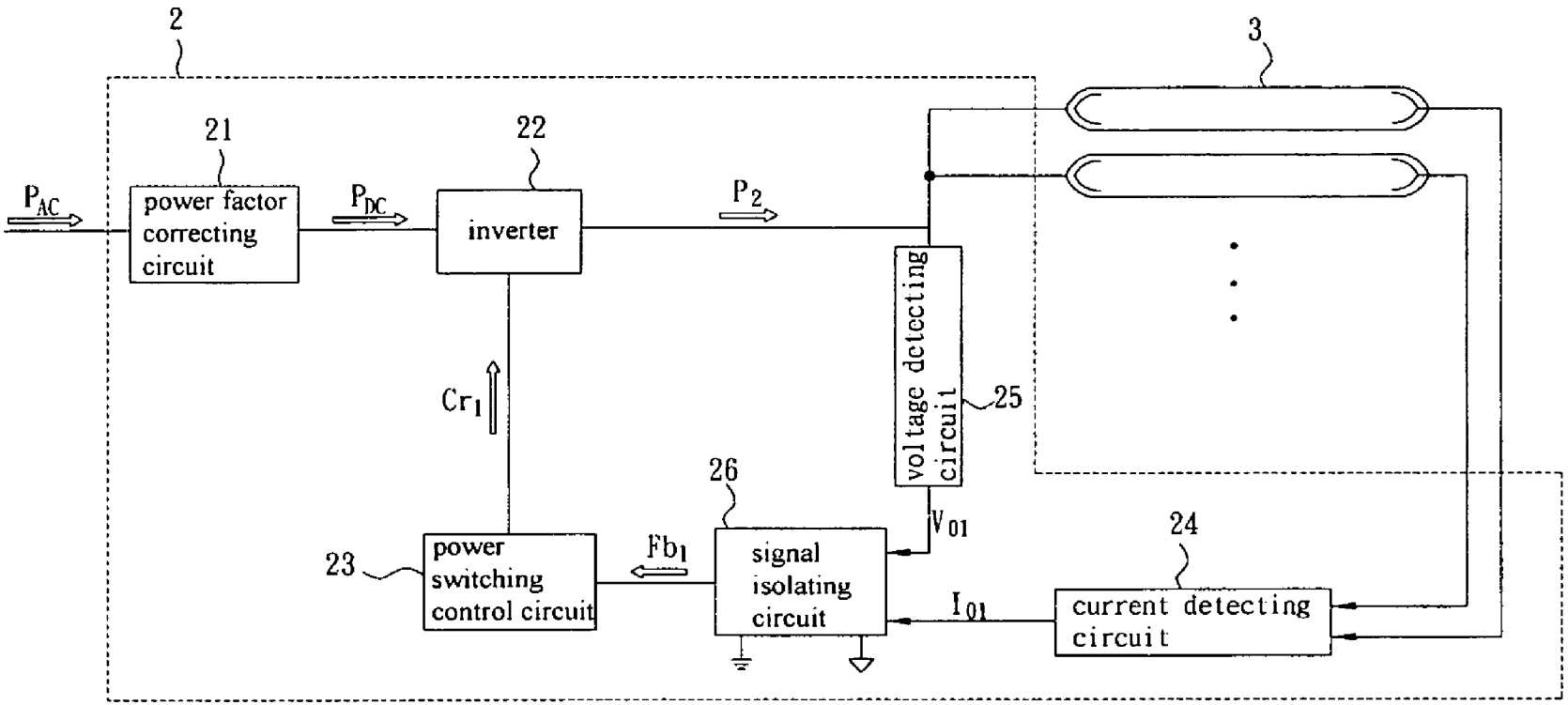
FIGS. 4A and 4B are schematic architecture illustrations each showing the driving device of the backlight module used in conjunction with a current detecting circuit, a voltage detecting circuit and a signal isolating circuit according to the preferred embodiment of the invention.

Referring to FIG. 4A, the driving device 2 of the backlight module according to this embodiment further includes a current detecting circuit 24, a voltage detecting circuit 25 and a signal isolating circuit 26.

The current detecting circuit 24 is electrically connected to the light-emitting unit 3 and detects a current value of the light-emitting unit 3 to generate a current signal $I_{01}$. The voltage detecting circuit 25 is also electrically connected to the light-emitting unit 3 and detects a voltage value of the light-emitting unit 3 to generate a voltage signal $V_{01}$. The signal isolating circuit 26 includes, for example but not limited to, a light coupling device. The signal isolating circuit 26 is electrically connected to the current detecting circuit 24, the voltage detecting circuit 25 and the power switching control circuit 23, and generates a feedback signal $Fb_1$ according to the current signal $I_{01}$ and the voltage signal $V_{01}$. The power switching control circuit 23 generates the switching control signal $C_{r1}$ according to the feedback signal $Fb_1$.

Figure 4B:
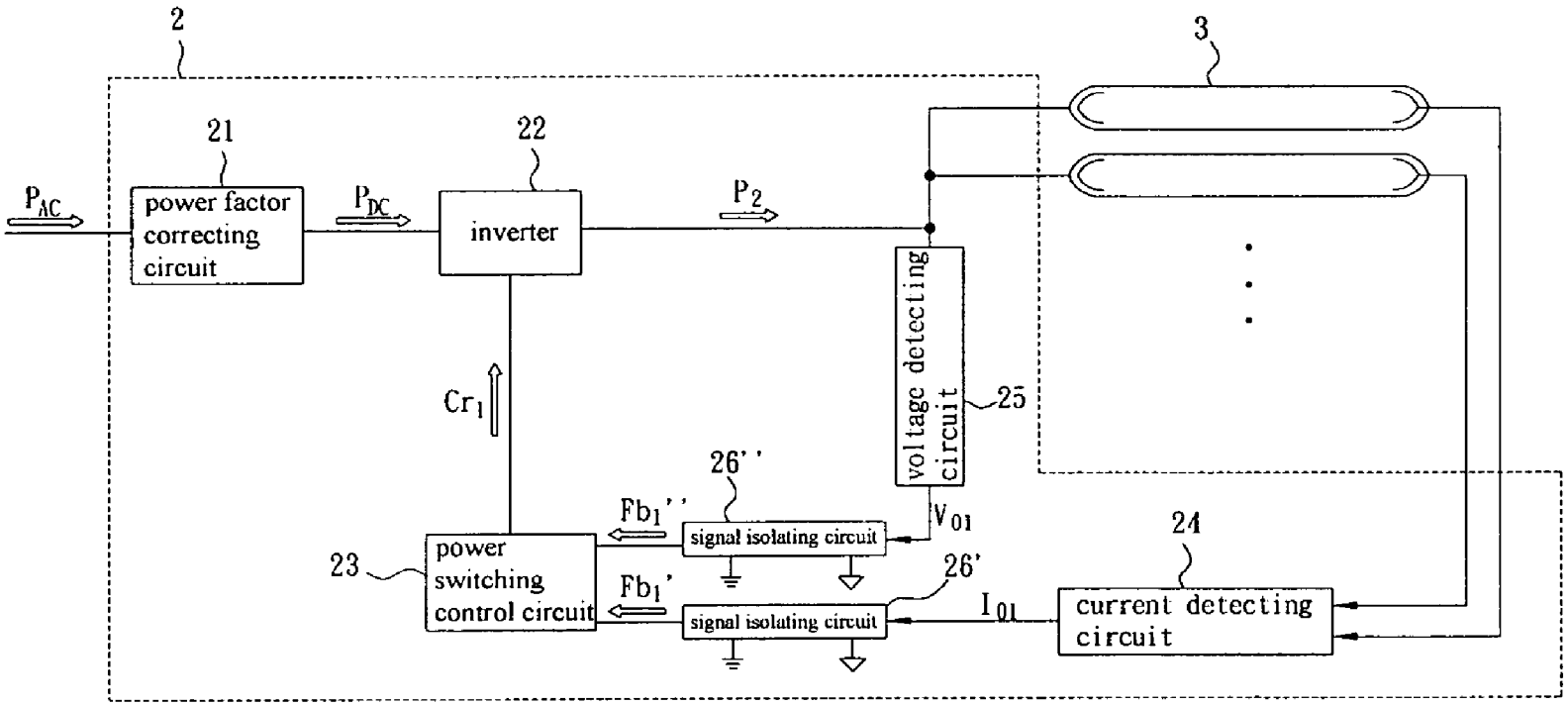

Of course, as shown in FIG. 4B, the current detecting circuit 24 and the voltage detecting circuit 25 are electrically connected to different signal isolating circuits 26' and 26", respectively. The signal isolating circuits 26' and 26" generate feedback signals $Fb_1'$ and $Fb_1''$ according to the current signal $I_{01}$ generated by the current detecting circuit 24 and the voltage signal $V_{01}$ generated by the voltage detecting circuit 25, respectively. The power switching control circuit 23 generates the switching control signal $C_{r1}$ according to the feedback signal $Fb_1$.

It is to be noted that the current detecting circuit 24 and the voltage detecting circuit 25 may not exist in the driving device 2 of the backlight module simultaneously. That is, only one of the current detecting circuit 24 and the voltage detecting circuit 25 is provided in the driving device 2 according to the requirement of the actual application.

In this embodiment, the architecture of the inverter 22 may have various modifications according to the requirements of different products or the actual requirement in design. Three architecture applications will be illustrated with reference to FIGS. 5A to 5C.

Figure 5A:
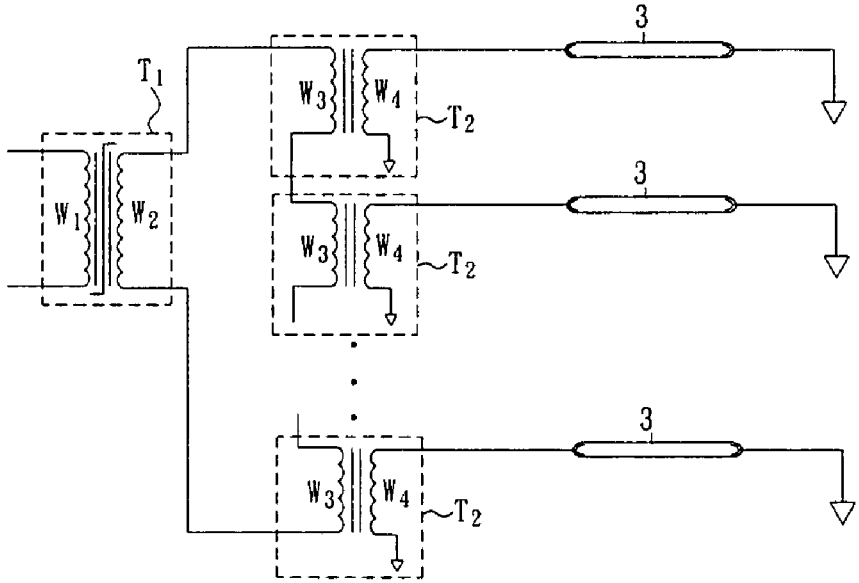
FIGS. 5A to 5C are schematic illustrations showing aspects of an electric-isolated circuit and a transforming circuit in the driving device of the backlight module according to the preferred embodiment of the invention.
Figure 5B:
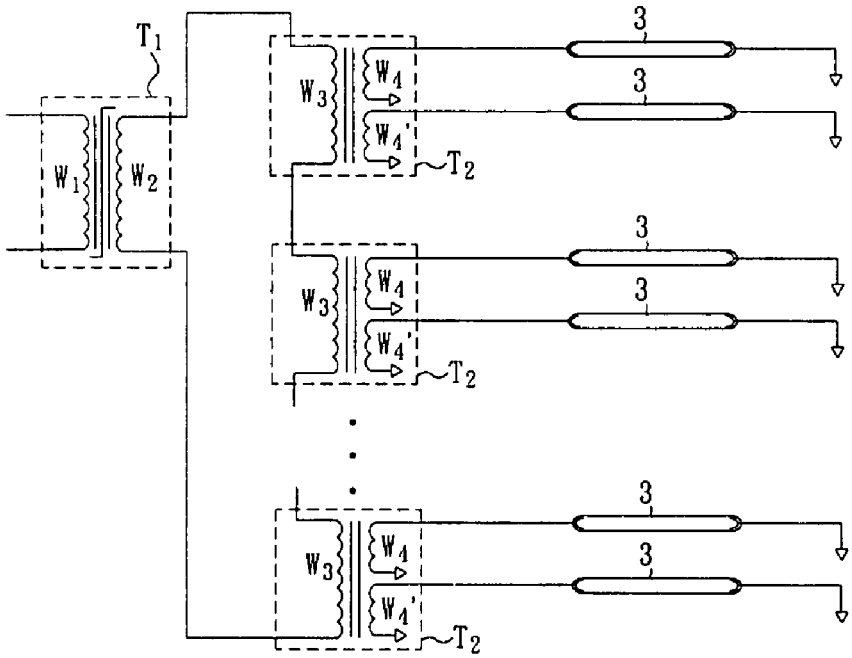
Figure 5C:
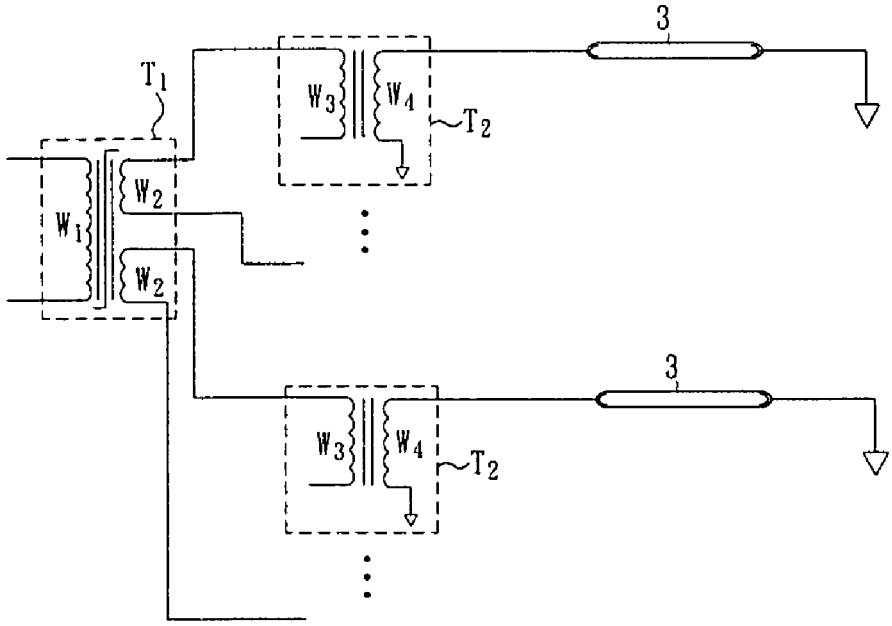

As shown in FIG. 5A, the inverter 22 has a plurality of boost transformers $T_2$. Each boost transformer $T_2$ has a primary winding $W_3$ and a secondary winding $W_4$. The primary windings $W_3$ are electrically connected in series, and each secondary winding $W_4$ is electrically connected to at least one light-emitting unit 3. As shown in FIG. 5B, each boost transformer $T_2$ further has another secondary winding $W_4'$ coupled to the primary winding $W_3$, and the secondary windings $W_4$ and $W_4'$ are electrically connected to the light-emitting units 3, respectively. As shown in FIG. 5C, the isolated transformer $T_1$ of the inverter 22 may have a plurality of second windings $W_2$ coupled to the first winding $W_1$, and each second winding $W_2$ is electrically connected to one boost transformer $T_2$. The connections of the light-emitting unit 3 and the secondary windings $W_4$ and $W_4'$ of the boost transformer $T_2$ in FIGS. 5A to 5C are similar to those in FIGS. 3A and 3B, so detailed descriptions thereof will be omitted.

It is to be noted that the inverter 22 may have various aspects other than the aspects of the inverter 22 illustrated in FIGS. 5A to 5C, and one of ordinary skill in the art may easily design the aspects according the to actual requirement.

Figure 5D:
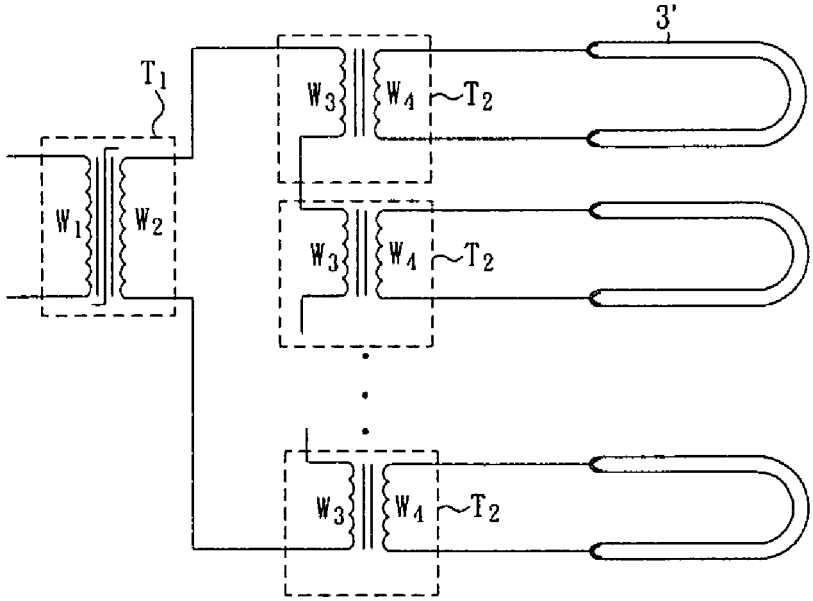
FIGS. 5D to 5F are schematic illustrations showing the aspects of FIGS. 5A to 5C, wherein the light-emitting units are U-shaped cold cathode fluorescent lamps.
Figure 5E:
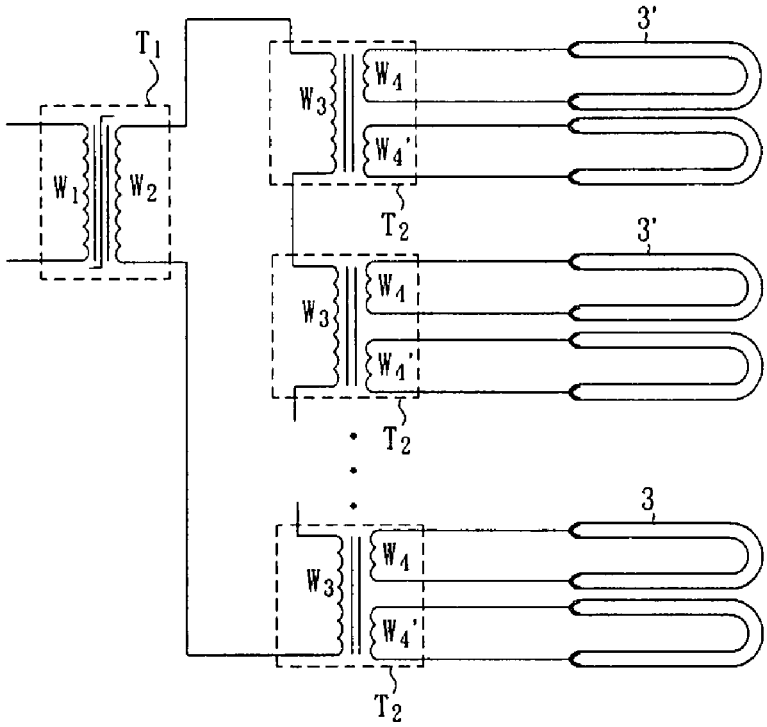
Figure 5F:
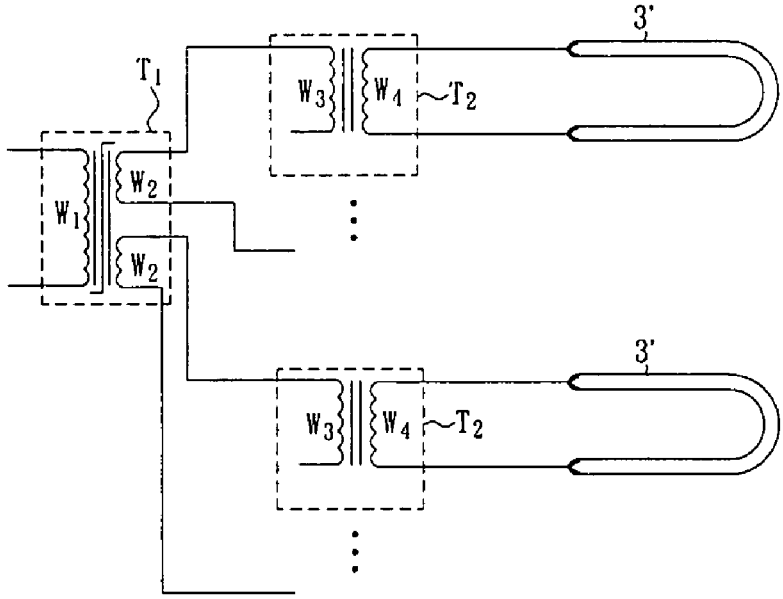

In addition, as shown in FIGS. 5D to 5F, the light-emitting units 3 are U-shaped CCFLs. Of course, the above description is for illustrating some of the possible variations only and is not to limit the scope of the applied light-emitting unit.

Figure 6A:
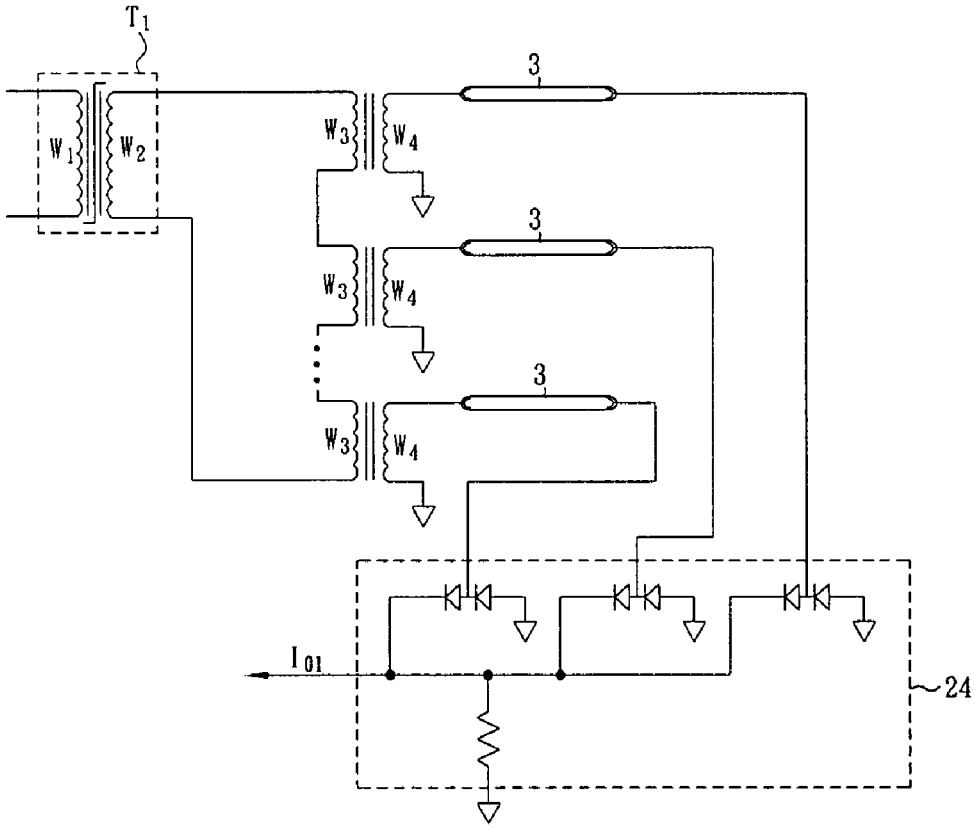
FIGS. 6A to 6F are schematic illustrations showing the driving devices with various aspects of current detecting circuits.
Figure 6B:
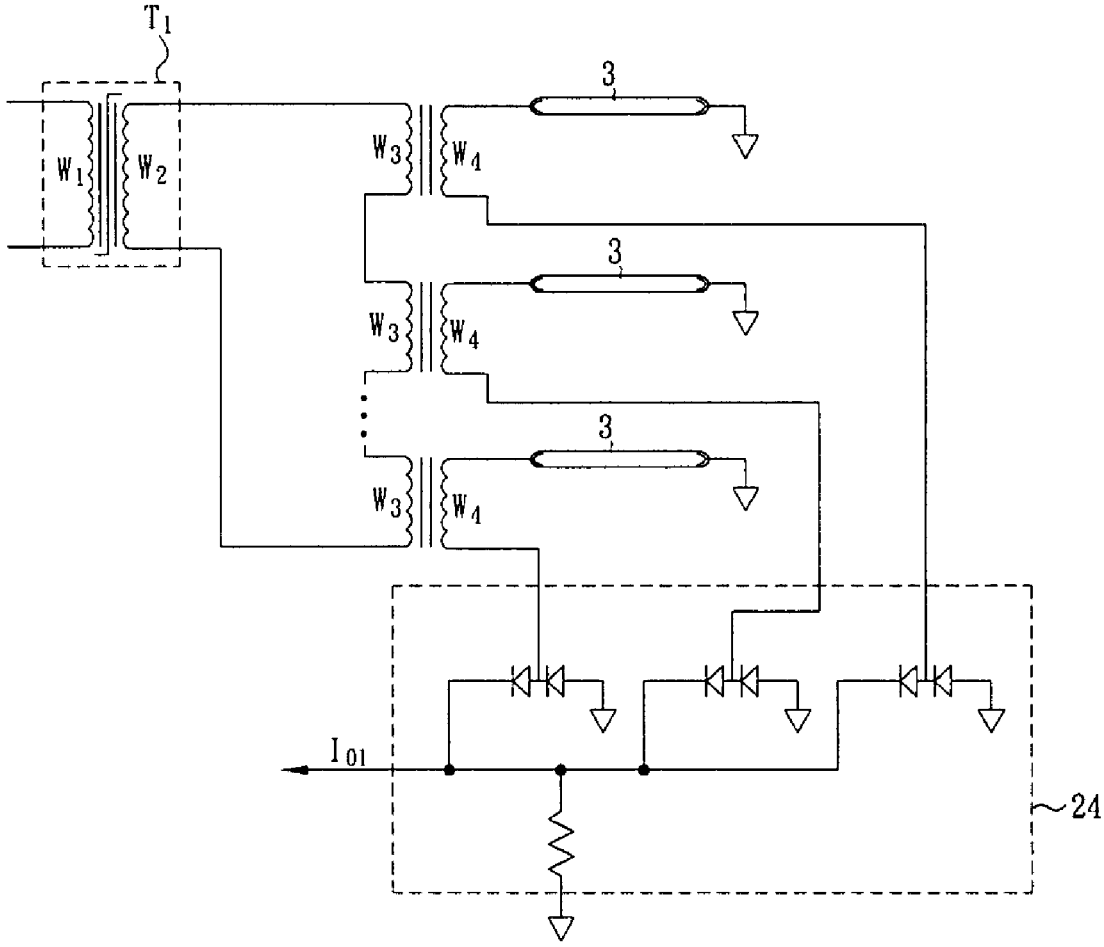
Figure 6C:
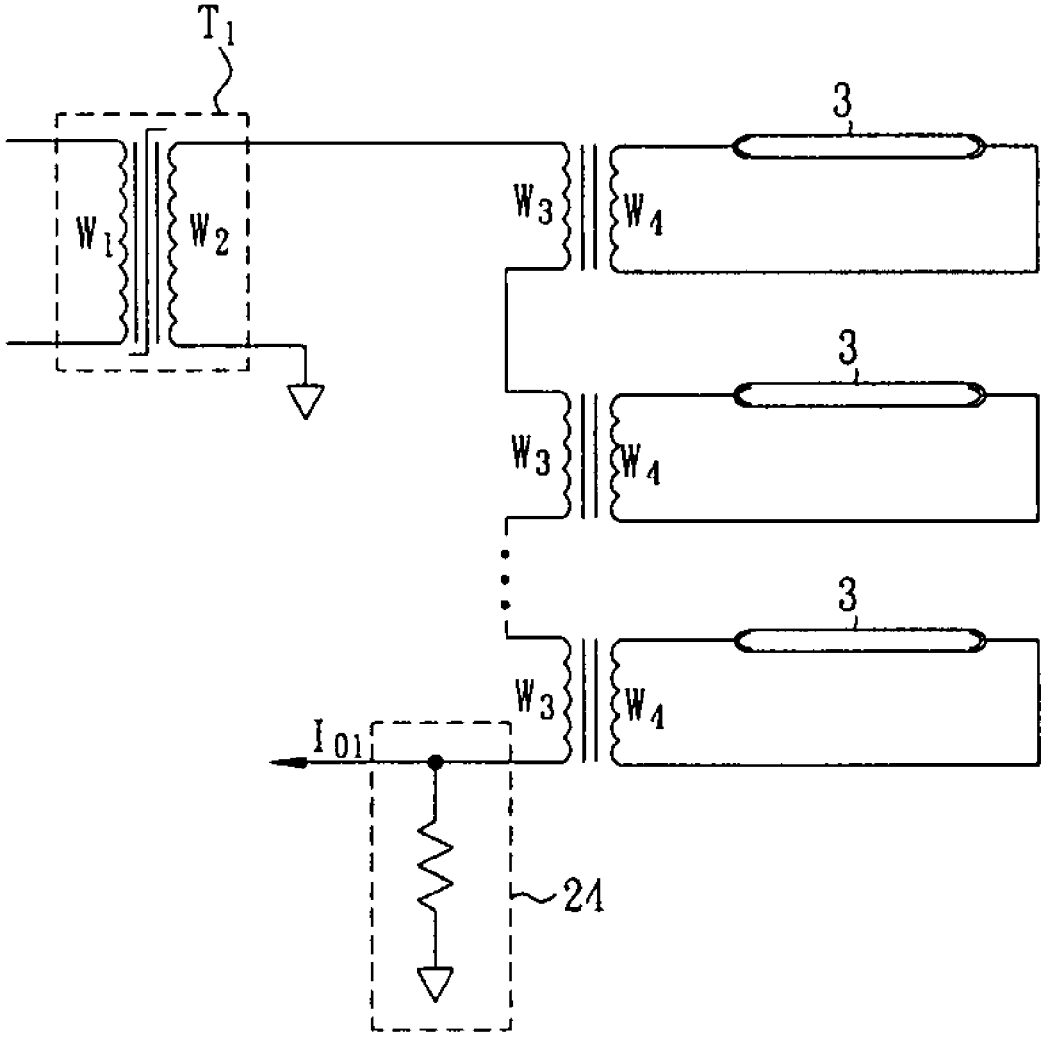

As mentioned above, if the inverter 22 includes a plurality of boost transformers $T_2$, the current detecting circuit 24 may have various connections as the following. Referring to FIG. 6A, the current detecting circuit 24 can retrieve the current signal $I_{01}$ from the lower voltage side of each light-emitting unit 3. Referring to FIG. 6B, the current detecting circuit 24 can retrieve the current signal $I_{01}$ from the secondary winding $W_4$ of each transforming circuit 223. Referring to FIG. 6C, the current detecting circuit 24 can retrieve the current signal $I_{01}$ from the primary winding $W_3$ of each transforming circuit 223.

Figure 6D:
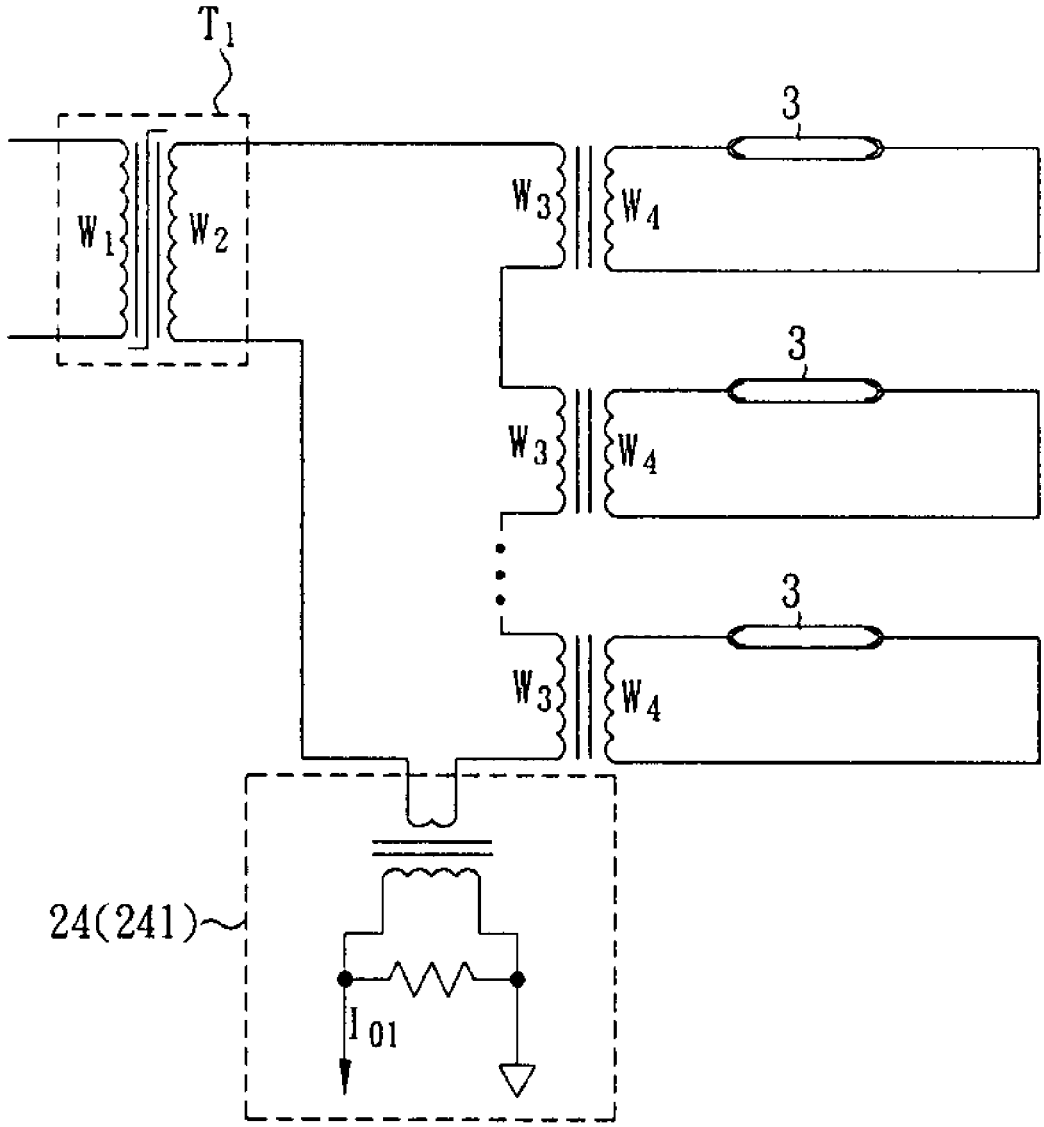
Figure 6E:
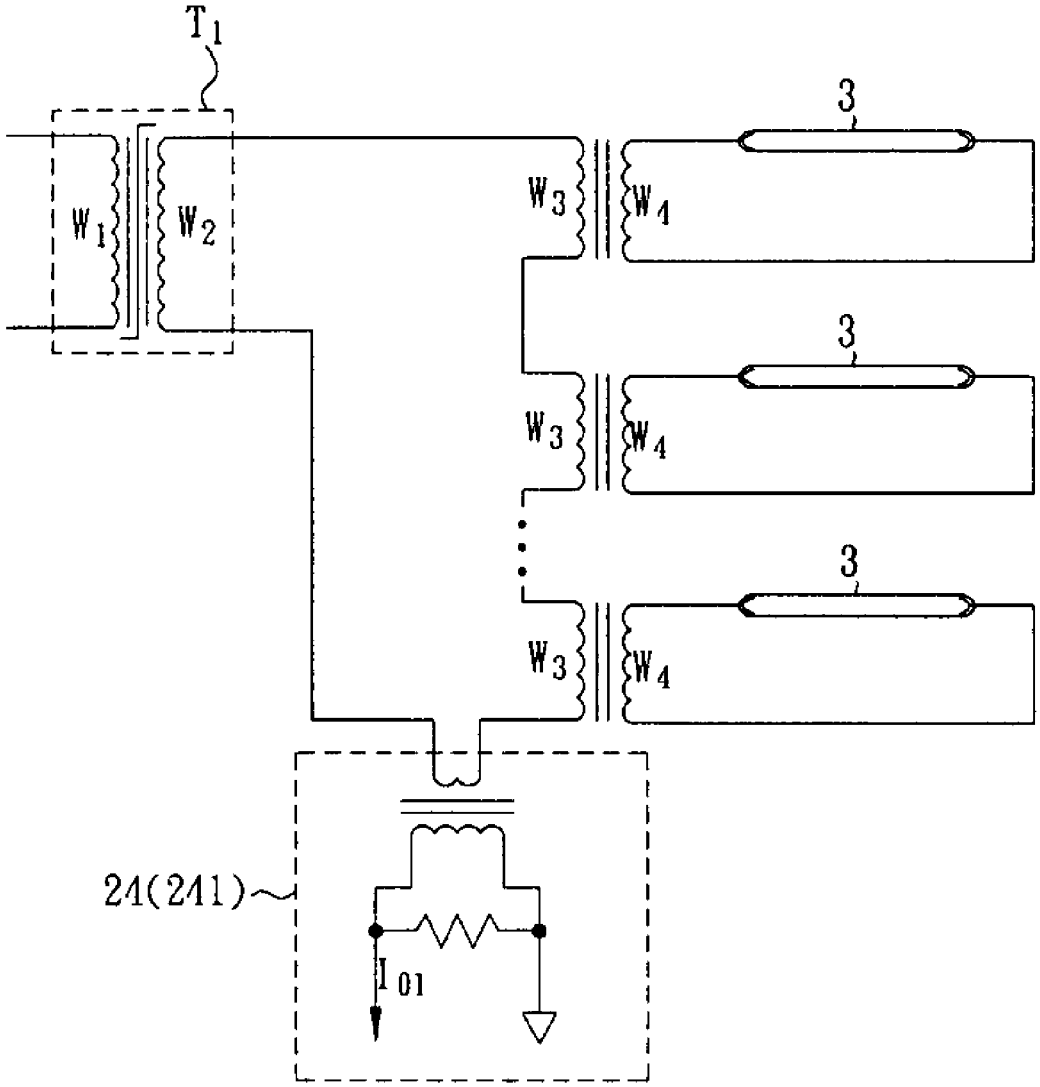
Figure 6F:
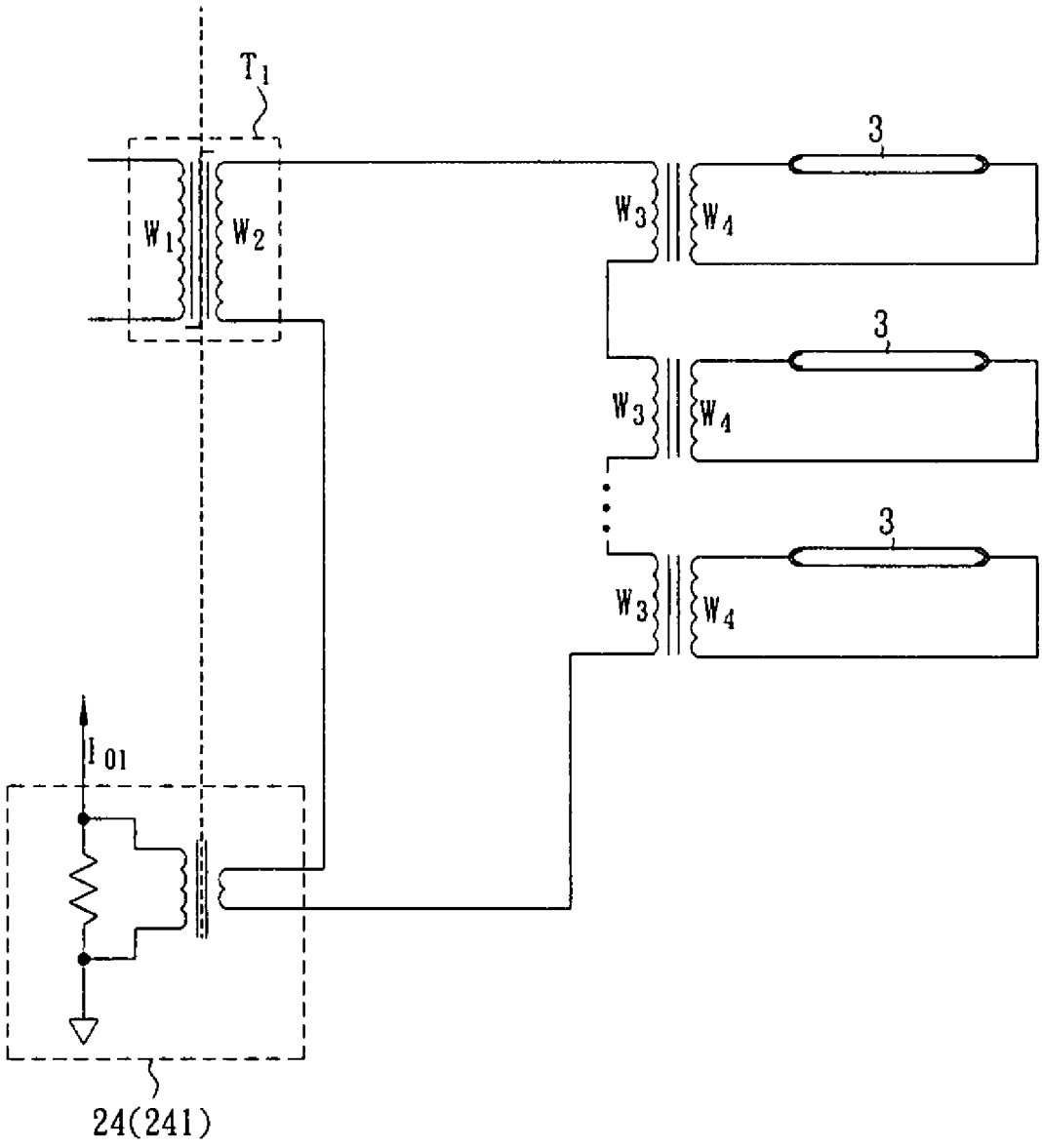

In addition, as shown in FIGS. 6D to 6F, the current detecting circuit 24 can be a current transformer 241, which is electrically connected to the primary winding $W_3$ of the transforming circuit 223 for retrieving the current signal $I_{01}$. In FIG. 6F, the current transformer 241 can also function as the signal isolating circuit 26.

Figure 7A:
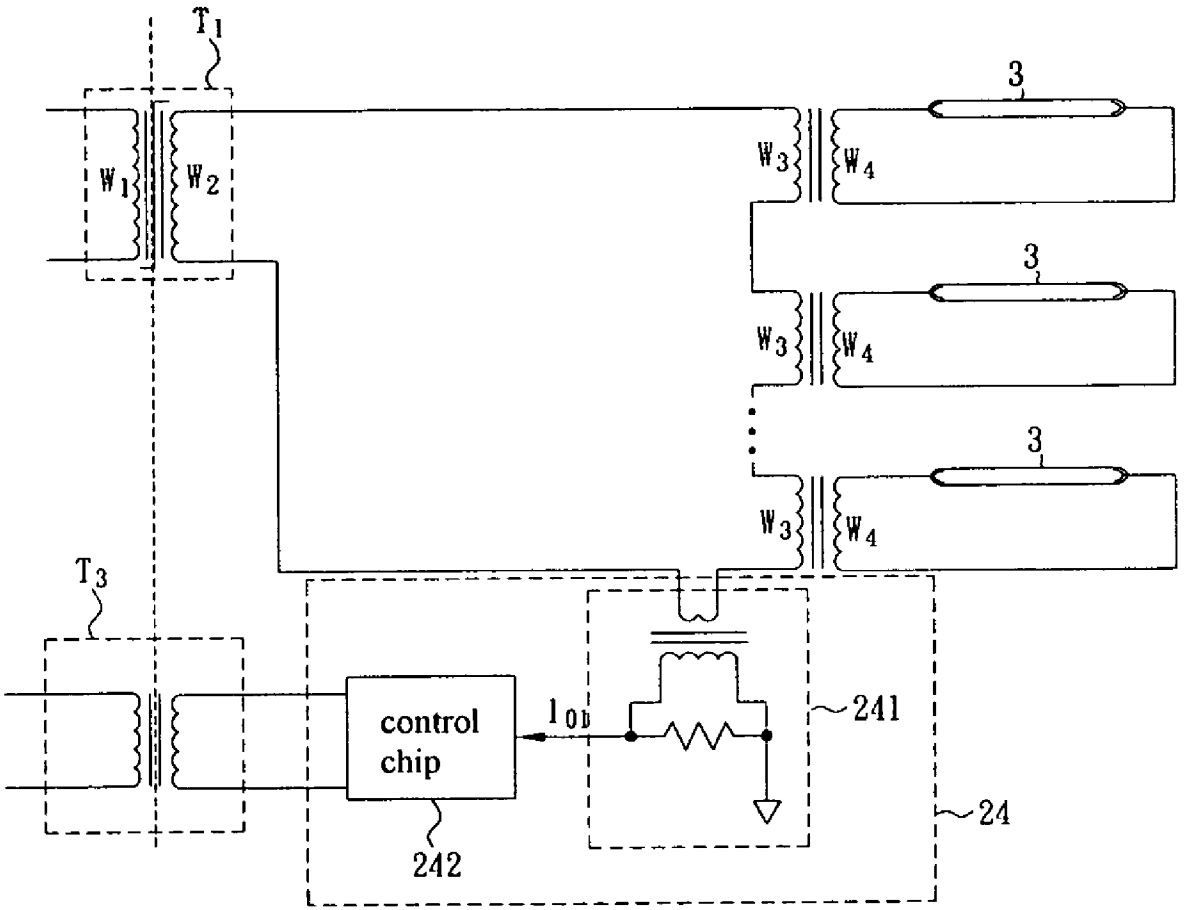
FIGS. 7A and 7B are schematic illustrations each showing the driving device of the backlight module according to the preferred embodiment, wherein the signal isolating circuit is an isolated transformer.
Figure 7B:
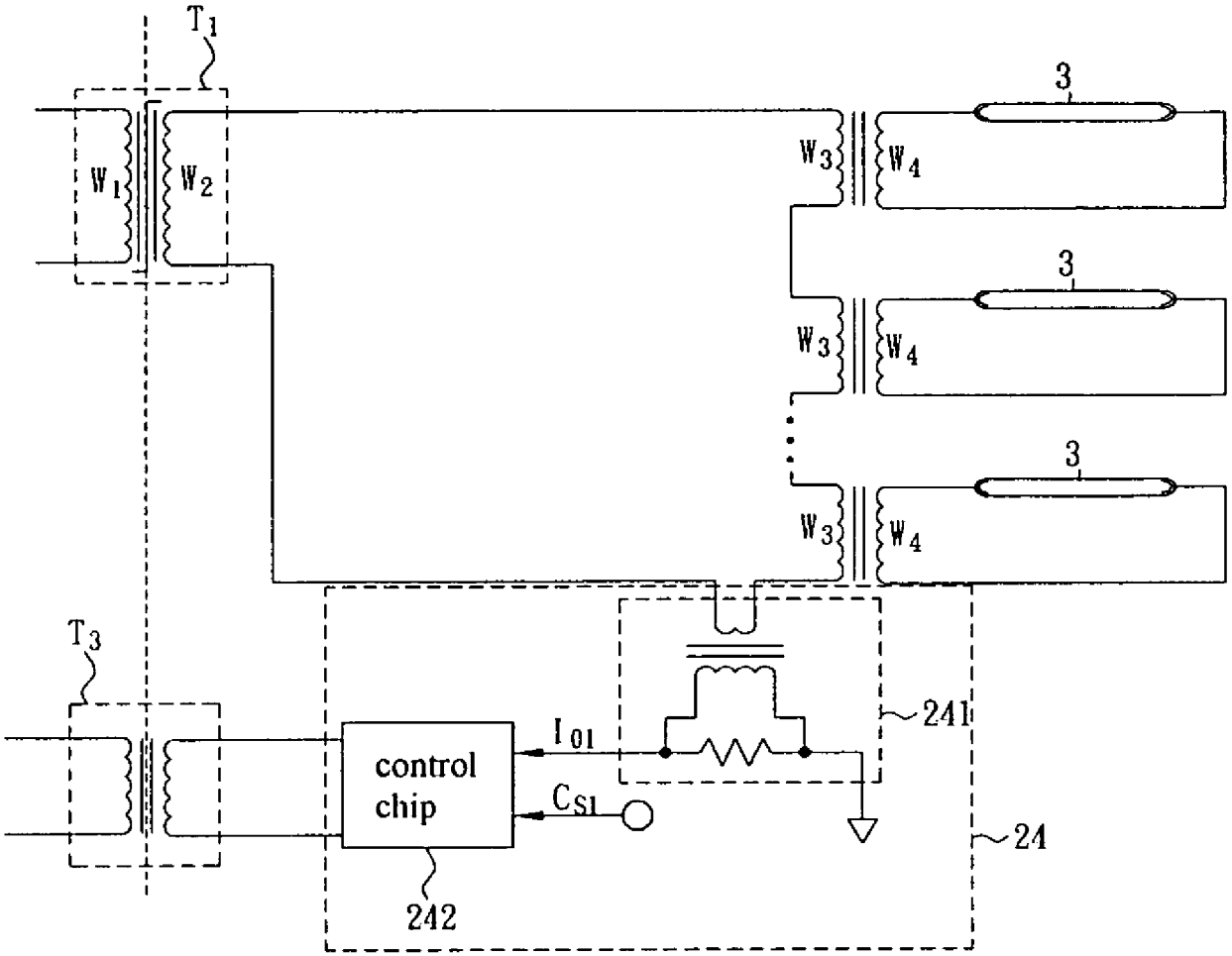
Figure 8A:
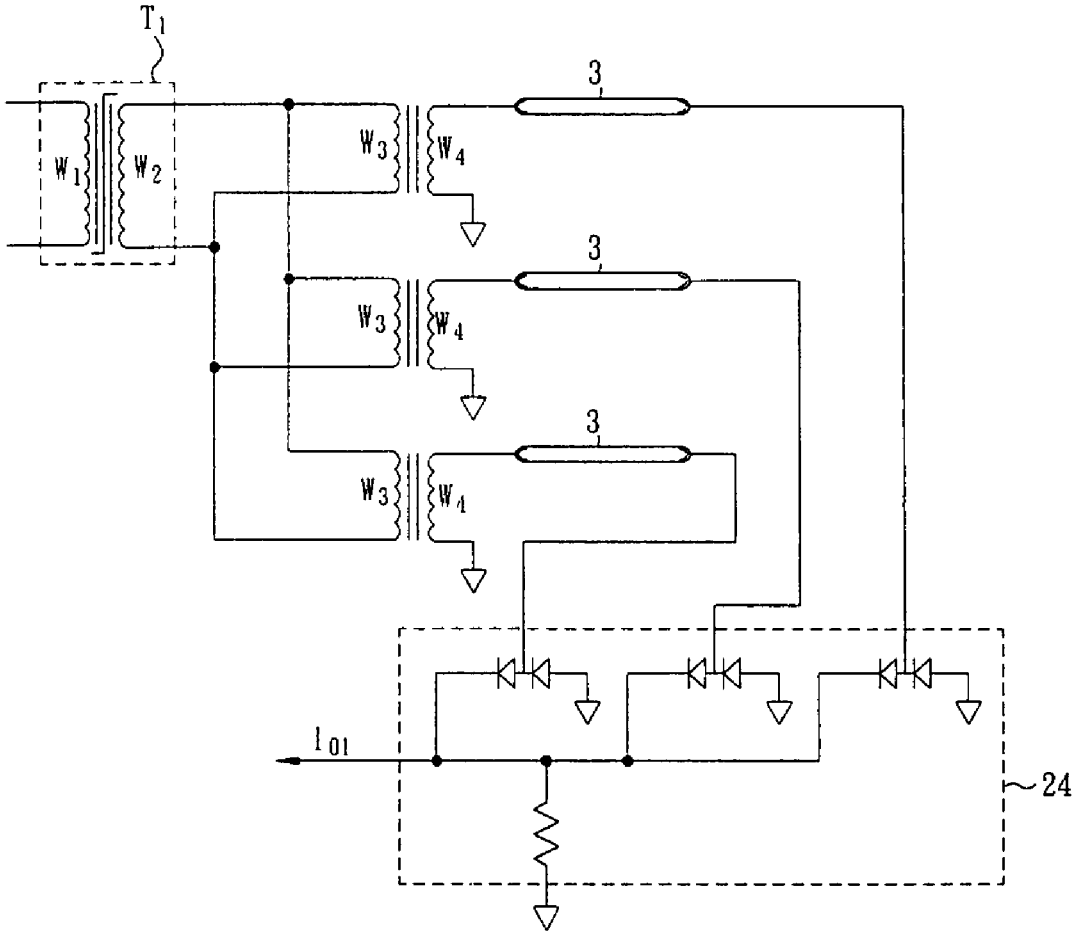
FIGS. 8A to 8D are schematic illustrations showing the driving device of the backlight module according to the preferred embodiment, wherein the third windings of the transforming circuit are connected in series.
Figure 8B:
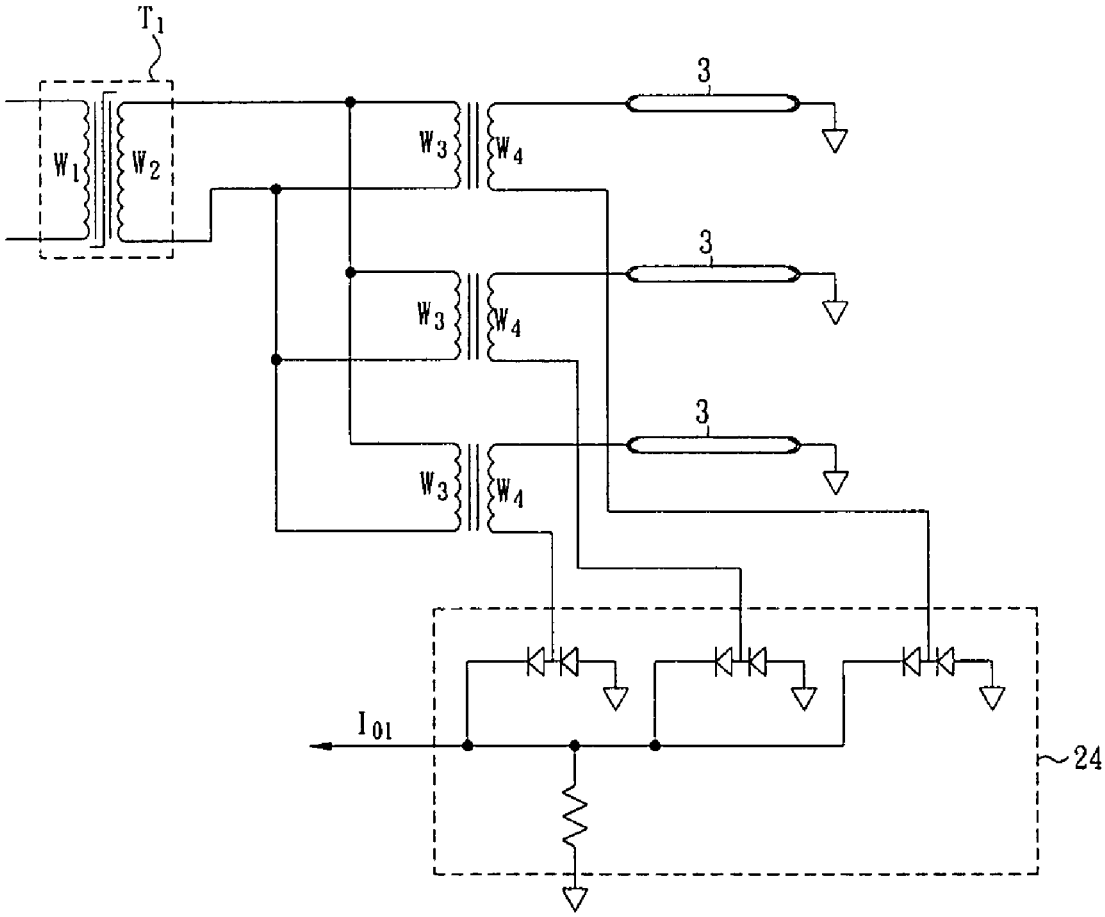
Figure 8C:
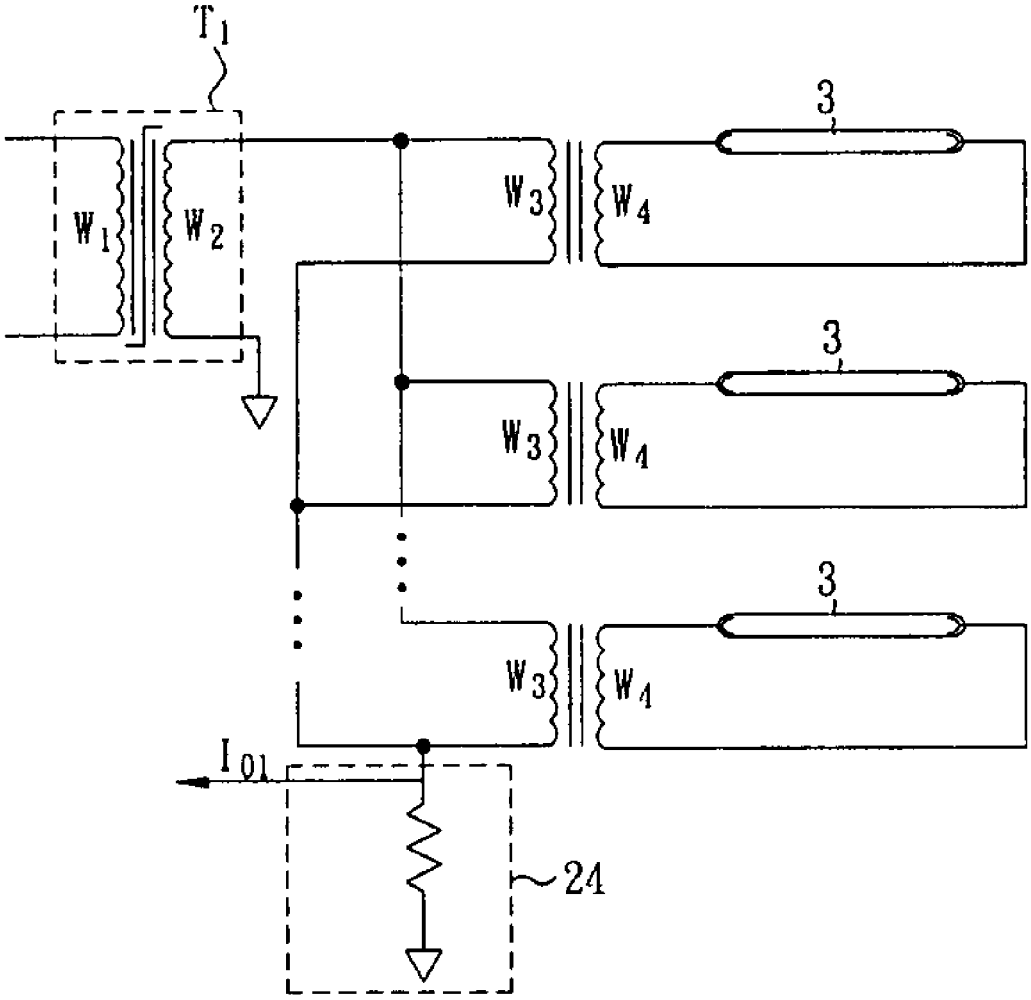
Figure 8D:
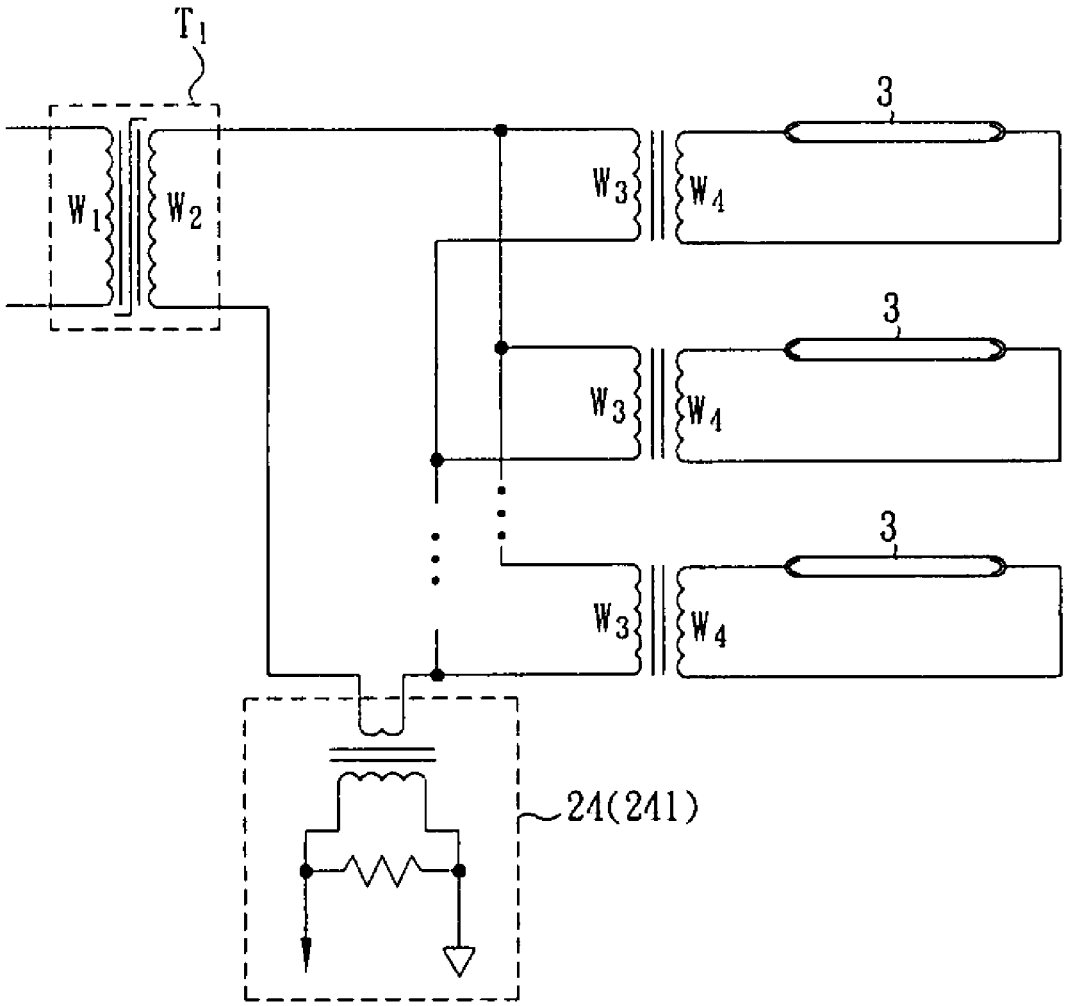

Excepting the above mentioned light coupling device, the signal isolating circuit 26 can be carried out by utilizing another isolated transformer $T_3$. As shown in FIG. 7A, the signal isolating circuit 26 is composed of a current transformer 241 and an isolated transformer $T_3$. The current signal $I_{01}$ outputted from the current transformer 241 is firstly processed by a control chip 242 and than outputted to the isolated transformer $T_3$. In addition, as shown in FIG. 7B, the control chip 242 may further receive a burst mode control signal $C_{S1}$ so as to perform diversified controls of the light-emitting units 3.

In the previous embodiments, the primary windings $W_3$ are connected in series. Of course, the primary windings $W_3$ of the transforming circuits 223 may be connected with each other in parallel (As shown in FIGS. 8A-8D), and the other current detecting circuits 24 are the same as those described hereinabove. Thus, the detailed descriptions thereof with reference to FIGS. 8A-8D are omitted.

Figure 9A:
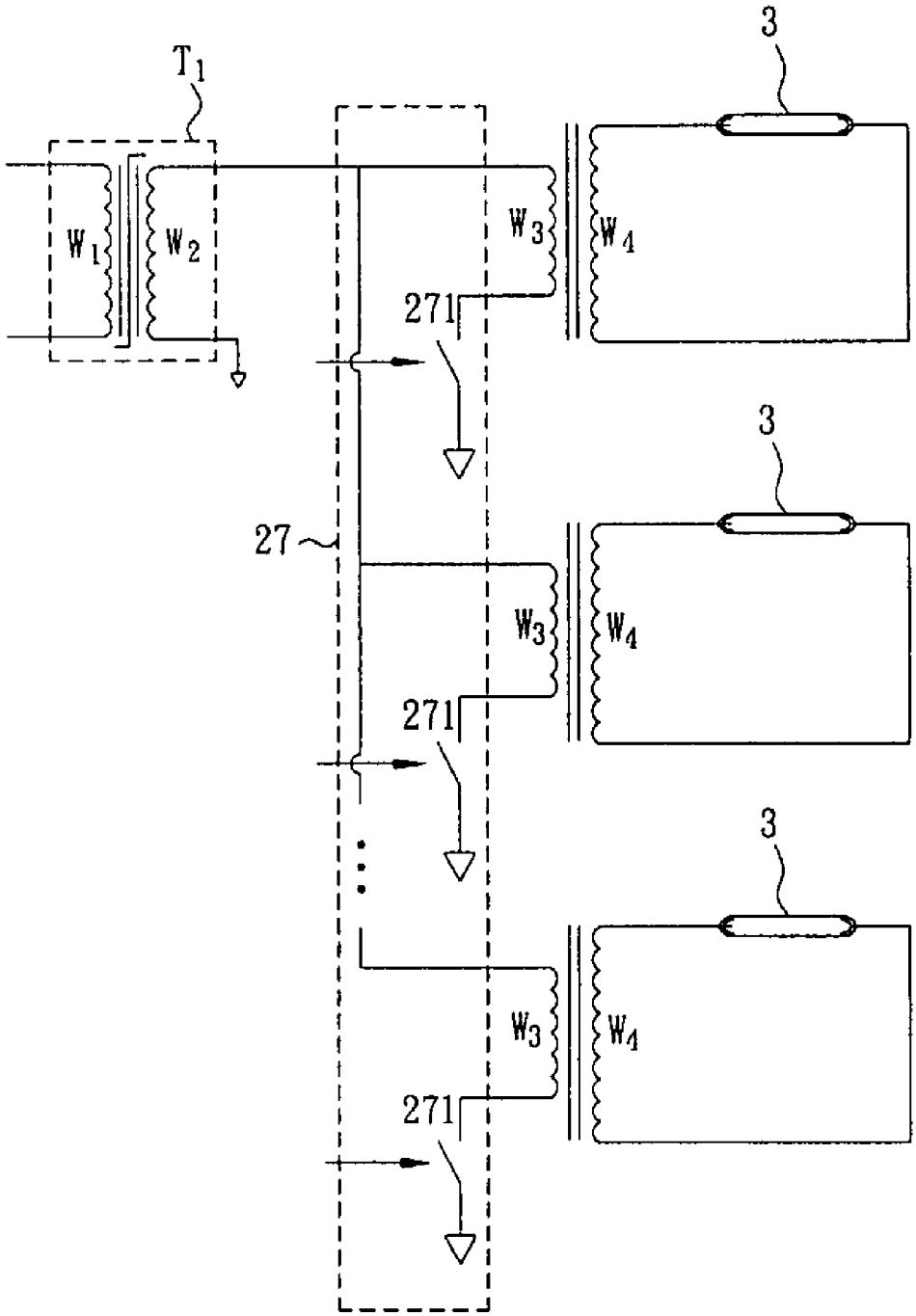
FIGS. 9A to 9C are schematic illustrations showing the driving device of the backlight module according to the preferred embodiment, wherein the driving device further includes a sequential control circuit.

With reference to FIG. 9A, the driving device 2 further includes a sequential control circuit 27, which is electrically connected to the boost transformers $T_2$ and controls to enable the boost transformers $T_2$ in sequence. In this embodiment, the sequential control circuit 27 includes a plurality of reset switches 271, which are coupled to the primary windings $W_3$ of the corresponding boost transformers $T_2$, respectively. The reset switches 271 are turned on or turned off according to a control signal.

Figure 9B:
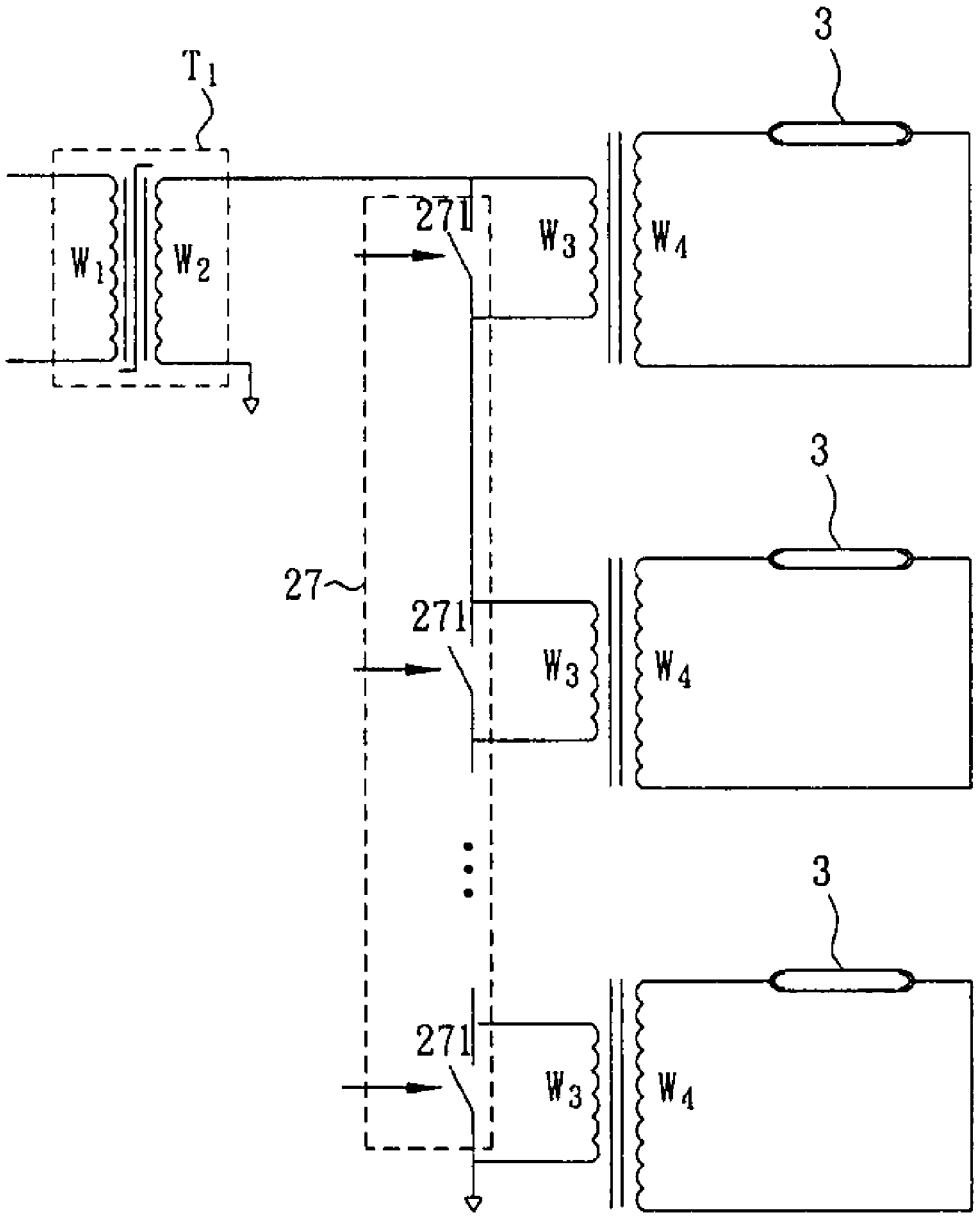
Figure 9C:
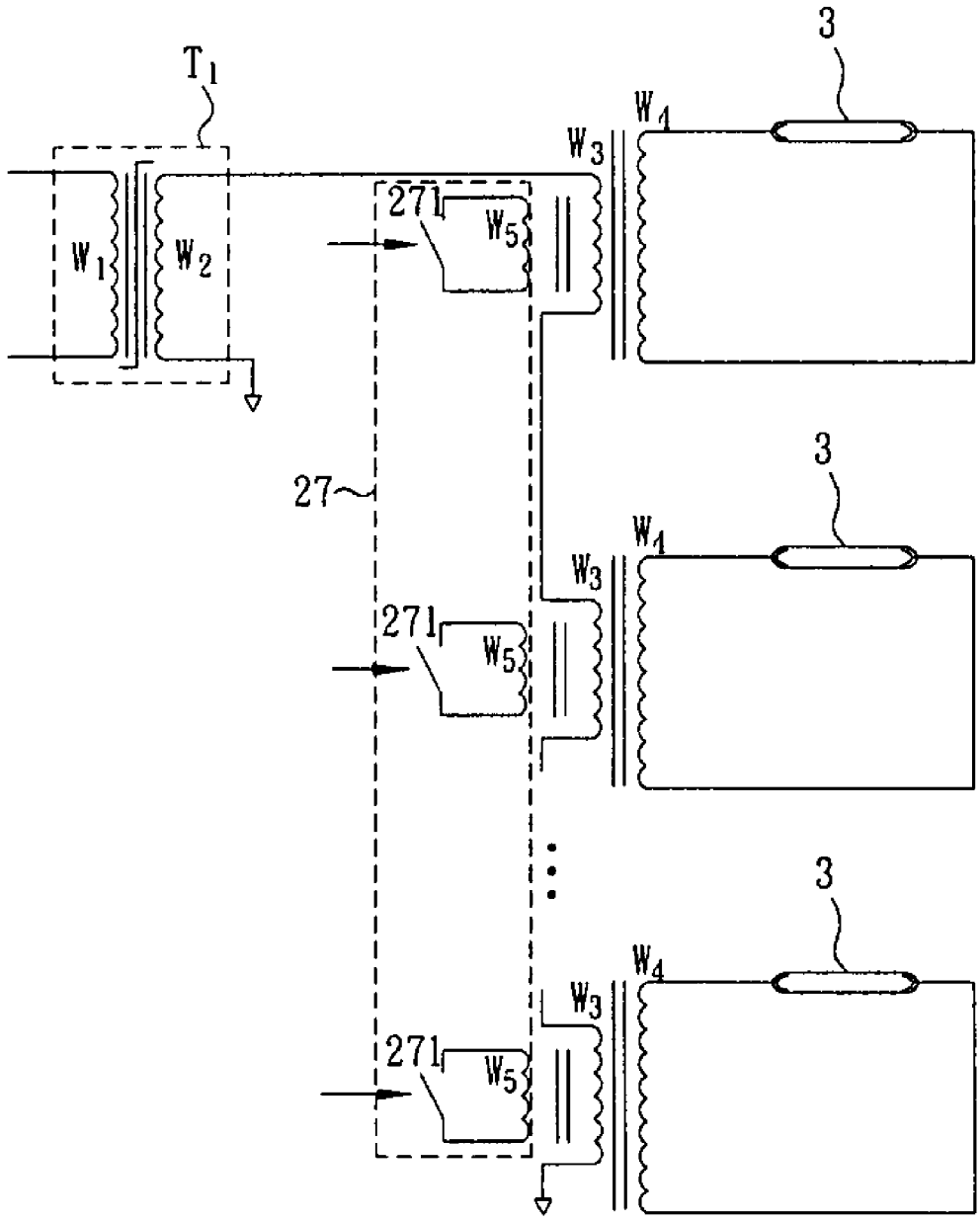

The corresponding reset switch 271 and the primary winding $W_3$ can be connected in series (as shown in FIG. 9A) or in parallel (as shown in FIG. 9B). Alternatively, as shown in FIG. 9C, each reset switch 271 may control the action of the transforming circuit 223 through a fifth winding $W_5$, which is coupled to the corresponding primary winding $W_3$ and reset switch 271.

Figure 10:
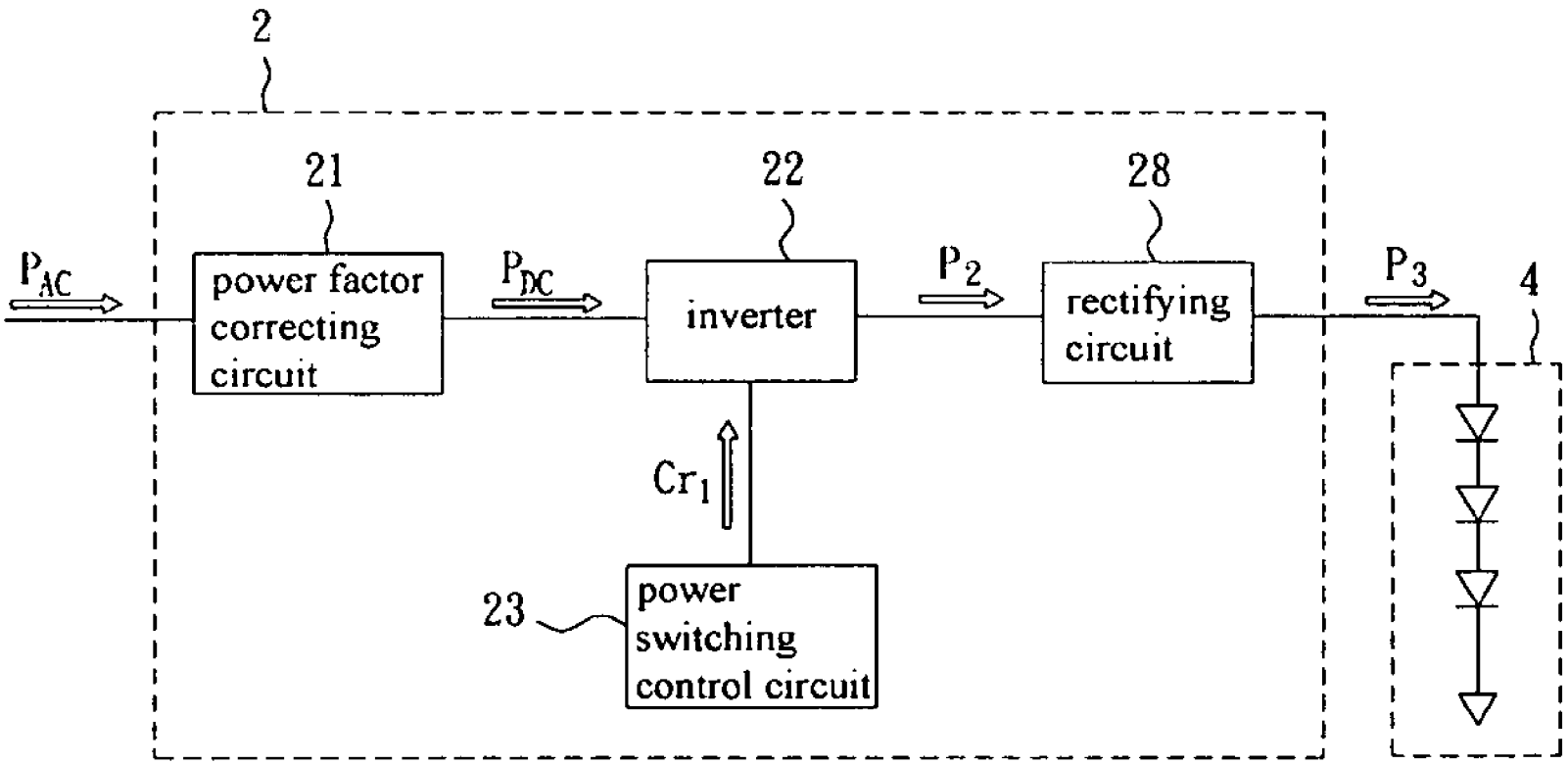
FIG. 10 is a schematic illustration showing the driving device of the backlight module according to the preferred embodiment, wherein the driving device further includes a rectifying circuit.

In the previously mentioned embodiments, the light-emitting units are CCFLs. Alternatively, the light-emitting units can be light-emitting diodes (LEDs). As shown in FIG. 10, if the light-emitting units 4 are LEDs, the driving device 2 further includes a rectifying circuit 28, which is electrically connected with the inverter 22 and the light emitting units 4. In this embodiment, the rectifying circuit 28 can be, for example but not limited to, a half-bridge rectifying circuit, a full-bridge rectifying circuit or a push-pull rectifying circuit. The rectifying circuit 28 can rectify the second power signal P2 outputted from the inverter 22 into a third power signal P3, which is a DC signal, for driving the light-emitting units 4. The other periphery circuits are similar to those of the above-mentioned examples, so the detailed descriptions will be omitted.

In addition, the inverter is applied to the backlight module in the above-mentioned example. Of course, the inverter may also be applied to any other limitative application, in which the DC power has to be transformed into the AC power.

In summary, an electric-isolated circuit is utilized to achieve the electric-isolating effect without modifying the design of the transforming circuit in the inverter and the driving device of the backlight module according to the invention. In addition, the drawback of the related art that the transforming circuits added with the increase of the number of the light-emitting units makes the size of the driving device be too large and increases the manufacturing cost due to the need of the isolating boost circuit can be improved. Also, the driving device of the backlight module of the invention may also use a single inverter to drive a single light-emitting unit or a plurality of light-emitting units according to the actual design requirement so that various designs of the circuit architecture may be satisfied.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. An inverter for driving at least cold cathode fluorescent lamp (CCFL), the inverter comprising:

a switching circuit for generating at least one switching signal according to a DC signal and at least one switching control signal;

an electric-isolated circuit having an electric-isolated side and a non-electric-isolated side, wherein the non-electric-isolated side is electrically connected to the switching circuit and generates a first power signal according to the switching signal;

a transforming circuit having a plurality of transformer each having a primary winding and at least one secondary winding coupled to the primary winding, wherein the primary windings are connected in series and electrically connected to the electric-isolated side of the electric-isolated circuit, the secondary winding is electrically connected to the CCFL, and the transforming circuit generates a second power signal to drive the CCFL according to the first power signal; and a sequential control circuit coupled to the transformers for respectively controlling to selectively enable or disable the transformers in sequence, wherein the sequential control circuit comprises a plurality of reset switches respectively coupled to the primary windings, and the reset switches are turned on or turned off in sequence.

2. The inverter according to claim 1, wherein the electric-isolated circuit comprises an isolated transformer having a first winding located at the non-electric-isolated side, and at least one second winding located at the electric-isolated side, and the first winding is coupled to the second winding.

3. The inverter according to claim 1, wherein the sequential control circuit further comprises a plurality of fifth windings coupled to the primary windings and the reset switches, respectively.

4. The inverter according to claim 1, wherein the reset switch and the primary winding are connected in series or in parallel.

5. A driving device of a backlight module for driving at least one load, the driving device comprising:

a power switching control circuit for generating at least one switching control signal;

an inverter electrically connected to the power switching control circuit and comprising a switching circuit, an electric-isolated circuit and a transforming circuit, wherein the switching circuit outputs at least one switching signal according to a DC signal and the switching control signal, the electric-isolated circuit has an electric-isolated side and a non-electric-isolated side, the non-electric-isolated side is electrically connected to the switching circuit and generates a first power signal according to the switching signal, the transforming circuit has a plurality of transformer each having a primary winding and at least one secondary winding coupled to the primary winding, the primary windings are connected in series and electrically connected to the electric-isolated side of the electric-isolated circuit and the secondary winding is electrically connected to the load, and the transforming circuit generates a second power signal to drive the light-emitting unit according to the first power signal; and a sequential control circuit coupled to the transformers for respectively controlling to selectively enable or disable the transformers in sequence, wherein the sequential control circuit comprises a plurality of reset switches respectively coupled to the primary windings, and the reset switches are turned on or turned off in sequence.

6. The driving device according to claim 5, wherein the electric-isolated circuit comprises an isolated transformer having a first winding located at the non-electric-isolated side, and at least one second winding located at the electric-isolated side, and the first winding is coupled to the second winding.

7. The driving device according to claim 5, wherein the sequential control circuit further comprises a plurality of fifth windings coupled to the primary windings and the reset switches, respectively.

8. The driving device according to claim 5, wherein the reset switch and the primary winding are connected in series or in parallel.

9. The driving device according to claim 5, further comprising:

a current detecting circuit electrically connected to the load for detecting a current value of the load to generate a current signal; and a signal isolating circuit electrically connected to the current detecting circuit and the power switching control circuit, and receiving the current signal to generate a feedback signal, wherein the power switching control circuit generates the switching control signal according to the feedback signal.

10. The driving device according to claim 9, wherein the current detecting circuit comprises a current transformer.

11. The driving device according to claim 9, wherein the signal isolating circuit comprises a light coupling device or an isolated transformer.

12. The driving device according to claim 5, further comprising:

a voltage detecting circuit electrically connected to the load for detects a voltage value of the load to generate a voltage signal; and a signal isolating circuit electrically connected to the voltage detecting circuit and the power switching control circuit, and receiving the voltage signal to generate a feedback signal, wherein the power switching control circuit generates the switching control signal according to the feedback signal.

13. The driving device according to claim 12, wherein the signal isolating circuit comprises a light coupling device or an isolated transformer.

14. The driving device according to claim 5, wherein the load comprises a cold cathode fluorescent lamp (CCFL) or a light-emitting diode (LED).

15. The driving device according to claim 5, further comprising:

a rectifying circuit electrically connected to the inverter and the load for receiving the second power signal and outputting a third power signal to drive the load.

16. An inverter for driving at least one light-emitting diode (LED), the inverter comprising:

a switching circuit for generating at least one switching signal according to a DC signal and at least one switching control signal;

an electric-isolated circuit having an electric-isolated side and a non-electric-isolated side, wherein the non-electric-isolated side is electrically connected to the switching circuit and generates a first power signal according to the switching signal;

a transforming circuit has a plurality of transformers each having a primary winding and at least one secondary winding coupled to the primary winding, wherein the primary windings are connected in series and electrically connected to the electric-isolated side of the electric-isolated circuit, and the secondary winding is electrically connected to the LED, the transforming circuit generating a second power signal to drive the LED according to the first power signal; and a sequential control circuit coupled to the transformers for respectively controlling to selectively enable or disable the transformers in sequence, wherein the sequential control circuit comprises a plurality of reset switches respectively coupled to the primary windings, and the reset switches are turned on or turned off in sequence.

* * * * *